US011753840B1

(12) United States Patent
Zhong et al.

(10) Patent No.: US 11,753,840 B1
(45) Date of Patent: Sep. 12, 2023

(54) FLOATING DEVICE AND ROBOTIC POOL CLEANER

(71) Applicant: Degrii Co., Ltd.

(72) Inventors: Liang Zhong, Jiangsu (CN); Hongyu Li, Jiangsu (CN); Ye Zhao, Jiangsu (CN); Fei Zhao, Jiangsu (CN)

( * ) Notice: Subject to any disclaimer, the term of this patent is extended or adjusted under 35 U.S.C. 154(b) by 0 days.

(21) Appl. No.: 18/149,907

(22) Filed: Jan. 4, 2023

(30) Foreign Application Priority Data

Sep. 9, 2022 (CN) ..... 202211099591.3
Sep. 27, 2022 (CN) ..... 202211182308.3

(51) Int. Cl.
*E04H 4/16* (2006.01)

(52) U.S. Cl.
CPC ..... *E04H 4/1654* (2013.01); *E04H 4/16* (2013.01); *E04H 4/1636* (2013.01)

(58) Field of Classification Search
CPC ..... E04H 4/16; E04H 4/1654; E04H 4/1636
See application file for complete search history.

(56) References Cited

U.S. PATENT DOCUMENTS

2007/0094817 A1* 5/2007 Stoltz ..... E04H 4/1636 15/1.7
2018/0142487 A1* 5/2018 Durvasula ..... F04D 29/708
2018/0224856 A1* 8/2018 Durvasula ..... G05D 1/027
2019/0032357 A1* 1/2019 Pichon ..... B01D 46/0086
2019/0284827 A1* 9/2019 Witelson ..... B60L 53/12
2022/0137599 A1* 5/2022 Hayes ..... G05B 19/4155 700/28

FOREIGN PATENT DOCUMENTS

| | | | |
|---|---|---|---|
| CN | 101725263 | A | 6/2010 |
| CN | 103534425 | A | 1/2014 |
| CN | 208093718 | U | 11/2018 |
| CN | 111350383 | A | 6/2020 |
| CN | 114753680 | A | 7/2022 |
| EP | 1122382 | A1 | 8/2001 |
| KR | 20200089966 | A | 7/2020 |

OTHER PUBLICATIONS

International search report of PCT/CN2023/070443.

* cited by examiner

*Primary Examiner* — Michael D Jennings

(57) ABSTRACT

The present application provides a floating device and a robotic pool cleaner, which relate to the technical field of swimming pool cleaning. the floating device has a wireless communication function, so that instructions can be transmitted to the wireless transmission module remotely through a remote controller, thereby controlling the walking and working status of the cleaning device of the robotic pool cleaner, which can realize intelligent cleaning path planning, and can also know the working position and working status of the robotic pool cleaner in time, which greatly improves the convenience of use and cleaning efficiency.

20 Claims, 17 Drawing Sheets

FLOATING DEVICE AND ROBOTIC POOL CLEANER

CROSS REFERENCE TO RELATED APPLICATIONS

The present application claims priority to Chinese Patent Application No. 2022110995913, filed with the Chinese Patent Office on Sep. 9, 2022 and entitled "a floating device and swimming pool cleaning machine" and Chinese Patent Application No. 2022111823083, filed with the Chinese Patent Office on Sep. 27, 2022 and entitled "a floating platform and robotic pool cleaner", which are incorporated by reference in its entirety.

TECHNICAL FIELD

The present disclosure relates to the technical field of swimming pool cleaning, and in particular, to a floating device and robotic pool cleaner.

BACKGROUND

The water in the swimming pool needs to be cleaned regularly. In order to remove the pollutants in the swimming pool, robotic pool cleaners have been developed. In the prior art, the robotic pool cleaners are mainly divided into two categories. One is that the cleaning device is connected to a power supply through a power cable, and the power cable is dragged to move together with the cleaning device when the cleaning device works underwater. When such robot is used, the power cable is easy to get entangled which affects the normal work, and the power cable needs to be stored, so it is very inconvenient to use. The other is a wireless robot that moves without the power cable being dragged, and it is equipped with a power supply assembly for supplying power. This category of robot is more convenient to use, however, it cannot intelligently plan the cleaning path, and the user cannot keep track of its working status in time, that is, it is still inconvenient to use, and the cleaning efficiency is still relatively low.

SUMMARY

A first purpose of the present disclosure is to provide a floating device to solve the technical problems of inconvenient use and low cleaning efficiency of robotic pool cleaners in the prior art.

The floating device provided by the present disclosure comprises a floating base and a wireless transmission module, wherein the wireless transmission module is packaged on the floating base.

Optionally, the floating base has a raised portion protruding from its upper surface, and the wireless transmission module is packaged in the raised portion.

Optionally, the floating device further comprises a first power supply assembly, wherein the first power supply assembly is packaged inside the floating base and electrically connected to the wireless transmission module.

Optionally, the floating base is a shell structure, comprising a first upper shell and a first chamber shell, the first chamber shell is sealed and fixed on the lower surface of the first upper shell, and the first power supply assembly is arranged in a sealed chamber enclosed by the first upper shell and the first chamber shell.

Optionally, a first sealing ring is provided between the first chamber shell and the first upper shell.

Optionally, the power supply assembly is arranged at the central portion of the floating base.

Optionally, the floating base further comprises a first lower shell, wherein the first lower shell is frame-shaped and is arranged to surround the first chamber shell, and to be fixedly connected with the first upper shell.

Optionally, the first lower shell is provided with a lower groove, and the inner side of the lower groove is higher than the outer side of the lower groove, and the inner side of the lower groove is seal-connected with the first upper shell.

Optionally, a second sealing ring is provided between the inner side of the lower groove and the first upper shell.

Optionally, the upper surface of the floating base is covered with a first solar panel, wherein the first solar panel is electrically connected to the first power supply assembly.

Optionally, the floating base is provided with a charging interface configured to charge the first power supply assembly.

Optionally, the charging interface is contact or contactless.

Optionally, the charging interface is arranged on the upper surface of the floating base.

Optionally, the charging interface is arranged on the lower surface of the floating base.

Optionally, the wireless transmission module is packaged at the top part of the raised portion.

Optionally, the top part of the raised portion has a hollow structure and the wireless transmission module is arranged in the hollow structure at the top part of the raised portion.

Optionally, the raised portion comprises a second upper shell and a second lower shell fixedly connected to the second upper shell, the second lower shell is fixedly connected to the floating base, the wireless transmission module is packaged inside the hollow structure enclosed by the second upper shell and the second lower shell.

Optionally, the raised portion is a U-shaped handle structure with the opening facing downwards, and the hollow structure of the raised portion is arranged at the middle connecting section of the U-shaped handle structure.

Optionally, the wireless transmission module comprises at least one of: a WIFI module, a Bluetooth module and a Zigbee module.

Optionally, the floating device further comprises a first main control board, wherein the first main control board is arranged to communicate with the wireless transmission module and to be electrically connected to the first power supply assembly.

Optionally, the first main control board is arranged to be packaged inside the floating base.

Optionally, the floating device further comprises a first main control board, the wireless transmission module is arranged to communicate with the first main control board, and the first main control board is arranged to be connected to the first power supply assembly.

The floating device provided in the present disclosure has the following beneficial effect:

The floating device provided in the present disclosure can be easily lifted through the handle, and the floating device provided in the present disclosure has a function of wireless communication, thereby instructions can be transmitted to the wireless transmission module remotely through a remote controller, etc., and moreover the movement and working status of the cleaning device of the robotic pool cleaner can be controlled, thus to realize intelligent planning of the cleaning path, such as: planning the cleaning path of irregular-shaped swimming pools, and the working location and working status of the robotic pool cleaner can be known in time, which greatly improves the convenience of use and cleaning efficiency. The wireless transmission module is arranged on the top of the handle, which is relatively high relative to the floating shell, so there is less interference around and the signal strength is relatively strong, which ensures the effectiveness and stability of signal transmission.

A second purpose of the present disclosure is to provide a robotic pool cleaner to solve the technical problems of inconvenient use and low cleaning efficiency of the robotic pool cleaners in the prior art.

The robotic pool cleaner provided by the present disclosure comprises the above-mentioned floating device, cleaning device and connecting cable, and the first power supply assembly of the floating device is connected to the cleaning device through the connecting cable;

The floating device comprises a floating base and a wireless transmission module, the floating base has a raised portion protruding from its upper surface, and the wireless transmission module is packaged in the raised portion.

Optionally, the cleaning device comprises a cleaning housing, and a first cable through hole is arranged on the cleaning housing.

A motor assembly is arranged in the cleaning housing, the motor assembly comprises a motor box, a moving motor and a water pump motor are installed inside the motor box, and a second cable through hole is provided on the motor box.

The connecting cable passes through the first cable through hole and the second cable through hole and is connected with the moving motor and the water pump motor.

Optionally, the motor box comprises a box body and a box cover, both the box body and the box cover are provided with an end surface and a circumferential surface respectively such that the end surfaces and the circumferential surfaces on the box body and the box cover may cooperate with each other respectively, and a first axial sealing ring is arranged between the end surfaces that cooperate with each other, and a radial sealing ring is arranged between the circumferential surfaces that cooperate with each other.

Optionally, a fixing joint is provided outside the second cable through hole, which is configured to fix the connecting cable.

Optionally, the charging interface of the robotic pool cleaner is contact or contactless.

The robotic pool cleaner provided by the present disclosure has all the beneficial effects of the above-mentioned floating device, so details will not be repeated here.

Another purpose of the present disclosure is to provide a floating platform to solve the technical problems in the prior art that there are too many steps to start the floating platform, which makes the operator easily forget the steps, and the operation is complicated and the operation efficiency is low.

The floating platform provided by this disclosure comprises a floating body, a switch assembly and an antenna assembly arranged on the floating body; the switch assembly is configured to control the working state of an electric control system of the floating platform, and the antenna of the antenna assembly is configured to send and receive data with enhance signal strength; the switch assembly is connected with a linkage mechanism, and when the switch assembly is in an open state, the linkage mechanism is connected to the antenna assembly to restrict the antenna in a retracted state; the switch assembly can drive the linkage mechanism to move during a closing process, so as to release the restriction on the antenna.

Optionally, the antenna assembly comprises an elastic member, the elastic member acts between the floating body and the antenna, and makes the antenna always have a tendency to expand; the linkage mechanism comprises a first stopper, the first stopper is configured to restrict the antenna in the retracted state; the switch assembly comprises a movable part provided with a movable contact, and the movable part can drive the linkage mechanism to move during the closing process of the switch assembly, so that the first stopper is detached from the antenna, and the antenna can be expanded under the action of the elastic member.

Optionally, the linkage mechanism further comprises a driving part and a linkage part, the driving part is fixedly arranged on the movable part, the first stopper is fixedly arranged on the linkage part, and the linkage part has a guiding surface; the driving part abuts against the guiding surface during the closing process of the switch assembly, and can move along the guiding surface to push the linkage part to move, so that an angle is formed between the moving direction of the movable part and the moving direction of the first stopper detaching away from the antenna.

Optionally, the movable part is fixedly connected to the first stopper, and during the closing process of the switch assembly, the moving direction of the movable part is consistent with the moving direction of the first stopper detaching from the antenna.

Optionally, the switch assembly further comprises a switch box, the movable part is arranged in the switch box, and an operating part of the movable part is exposed; the linkage part is a slider, and the first stopper is fixedly arranged on the slider, and the slider is arranged in the switch box, and can move along the moving direction when the first stopper is detached from the antenna; when the antenna is in the retracted state, the first stopper protrudes from the switch box and is connected with the antenna; the movable part has a driving protrusion protruding from its outer wall to form the driving part; the slider is provided with a sliding slot, together with a groove wall against which the driving protrusion abuts, is configured to form the guiding surface, the driving protrusion is arranged in the sliding slot, during the closing process of the switch assembly, the driving protrusion can move along the sliding slot, and push the slider to move along the direction in which the first stopper is detached from the antenna.

Optionally, one of the switch box and the slider is provided with at least one guiding column, and the other is provided with at least one guiding groove, and the guiding groove extends along the moving direction of the first stopper, the guiding column is correspondingly plugged into the guide groove.

Optionally, the movable part is a pressing type, the pressing position of the movable part is exposed above the floating body, the movable part can move in a vertical direction, and the first stopper can move in a horizontal direction.

Optionally, the movable part is a toggle type, the toggle position of the movable part is exposed on the side of the floating body, the movable part can move in a vertical direction, and the first stopper can move in a horizontal direction.

Optionally, the linkage mechanism further comprises a first reset member, the first reset member is arranged in the switch box and connected between the inner wall of the switch box and the slider, and is configured so that the slider resets along the opposite direction of the moving direction when the first stopper is detached from the antenna.

Optionally, the switch assembly further comprises a second reset member, the second reset member is arranged in the switch box, and is connected between the inner wall of the switch box and the movable part, and is configured so that the movable part resets along the opposite direction of the moving direction when the switch assembly is closed.

Optionally, the antenna is rotatably arranged on the floating body, the elastic member of the antenna assembly is a torsion spring, and the torsion spring is connected between the floating body and the antenna, and the torsion spring makes the antenna have a constant tendency from rotating and popping up to an extended state.

Optionally, the antenna is provided with a second stopper, and the second stopper cooperates with the linkage mechanism so that the antenna is in a retracted state.

Optionally, one end of the antenna along its axial direction is connected to the floating body, and the second stopper is arranged at the other end of the antenna along its axial direction.

Optionally, the second stopper is a blocking plate.

Optionally, the antenna is telescopically installed on the floating body, and the elastic member of the antenna assembly makes the telescoping part of the antenna always have a tendency of stretching along the vertical direction.

Optionally, the floating platform further comprises a housing and a second power supply assembly, and the second power supply assembly is arranged in the housing and is located at the geometric center of the bottom.

Optionally, the outer bottom of the housing is arc-shaped.

Optionally, the floating platform further comprises a second solar panel, the second solar panel is arranged on the top of the floating body, the second solar panel is connected to the second power supply assembly, and is configured to charge the second power supply assembly.

The floating platform provided by this disclosure can produce the following beneficial effects:

In the floating platform provided by this disclosure, the floating body is provided with a switch assembly and an antenna assembly, wherein the antenna of the antenna assembly can enhance the signal strength of data transmission and reception, thereby enhancing the stability of remote wireless signal transmission, and further ensuring the normal operation of the entire device. When the switch assembly is in the open state, the linkage mechanism transmission connected with the switch assembly can restrict the antenna in the retracted state, so that the antenna is not easy to be damaged and broken, and since the antenna is in the retracted state, the floating platform occupies a small space and is easy to store; while during the closed process of the switch assembly, not only the electronic control system can be started by controlling the working state of the electronic control system, but also the restriction on the antenna can be released through the linkage mechanism, that is, the antenna can be extended without additional operations on the antenna, which increases the function of the switch assembly and reduces the starting steps of the floating platform which effectively solves the problem that the operator forgets the starting steps, and the starting operation is simple and efficient.

Another purpose of the present application is to provide a robotic pool cleaner to solve the technical problems in the prior art that there are too many steps to start the floating platform, causing the operator to easily forget the steps, and the operation is complicated and the operation efficiency is low.

The robotic pool cleaner provided in the present disclosure comprises the above-mentioned floating platform. The robotic pool cleaner has all the advantages of the above-mentioned floating platform, so it will not be repeated here.

EXPLANATION OF REFERENCE SIGNS

100—floating device; 101—floating base; 102—raised portion; 110—floating shell; 111—the first upper shell; 112—the first lower shell; 1121—lower groove; 113—the first chamber shell; 114—the first sealing ring; 115—the second sealing ring; 116—charging interface; 117—the first solar panel; 120—handle; 121—the second upper shell; 122—the second lower shell; 130—wireless transmission module; 140—the first power supply assembly; 150—the first main control board; 200—connecting cable; 300—cleaning device; 310—cleaning housing; 311—the first cable through hole; 320—motor assembly; 330—motor box; 331—box body; 332—the first receiving groove; 333—the first axial sealing ring; 335—box cover; 336—the second receiving groove; 337—the first radial sealing ring; 339—the second cable through hole; 340—fixing joint; 350—walking motor; 351—the third sealing ring; 360—water pump motor; 361—the fourth sealing ring; 370—the second main control board; 400—floating platform; 410—upper cover; 411—the second radial sealing ring; 412—the second solar panel; 420—lower housing; 422—cable connector; 424—the second axial sealing ring; 500—switch assembly; 510—the first front cover; 511—the first guiding column; 511'—the second guiding column; 520—the first rear cover; 530—movable part; 531—main body; 532—the first limit ring; 533—the second limit ring; 534—driving protrusion; 540—slider; 541—sliding slot; 542—guiding surface; 543—the first stopper; 544—chamfer; 545—the first guiding groove; 545'—the second guiding groove; 546—mounting column; 550—the first reset element; 560—the second reset element; 570—silicone element; 580—the first electric control board; 600—antenna assembly; 611—the second front cover; 612—the second rear cover; 613—rotating shaft; 614—chuck; 615—the second stopper; 620—torsion spring; 630—sealing ring; 700—the second power supply assembly; 710—battery box; 720—battery pack.

DETAILED DESCRIPTION

In order to make the above purposes, features and advantages of the present disclosure clearer, the specific implementation manners of the present disclosure will be described in detail below in conjunction with the accompanying drawings, which does not constitute a limitation to the present application.

The embodiment of the present disclosure provides a floating device 100, which is applied to a swimming pool robot. When in use, the floating device 100 is connected to a cleaning device 300 with a cable, so that the floating device 100 floats on the water surface, and the cleaning device 300 cleans the underwater parts.

Figure 1:
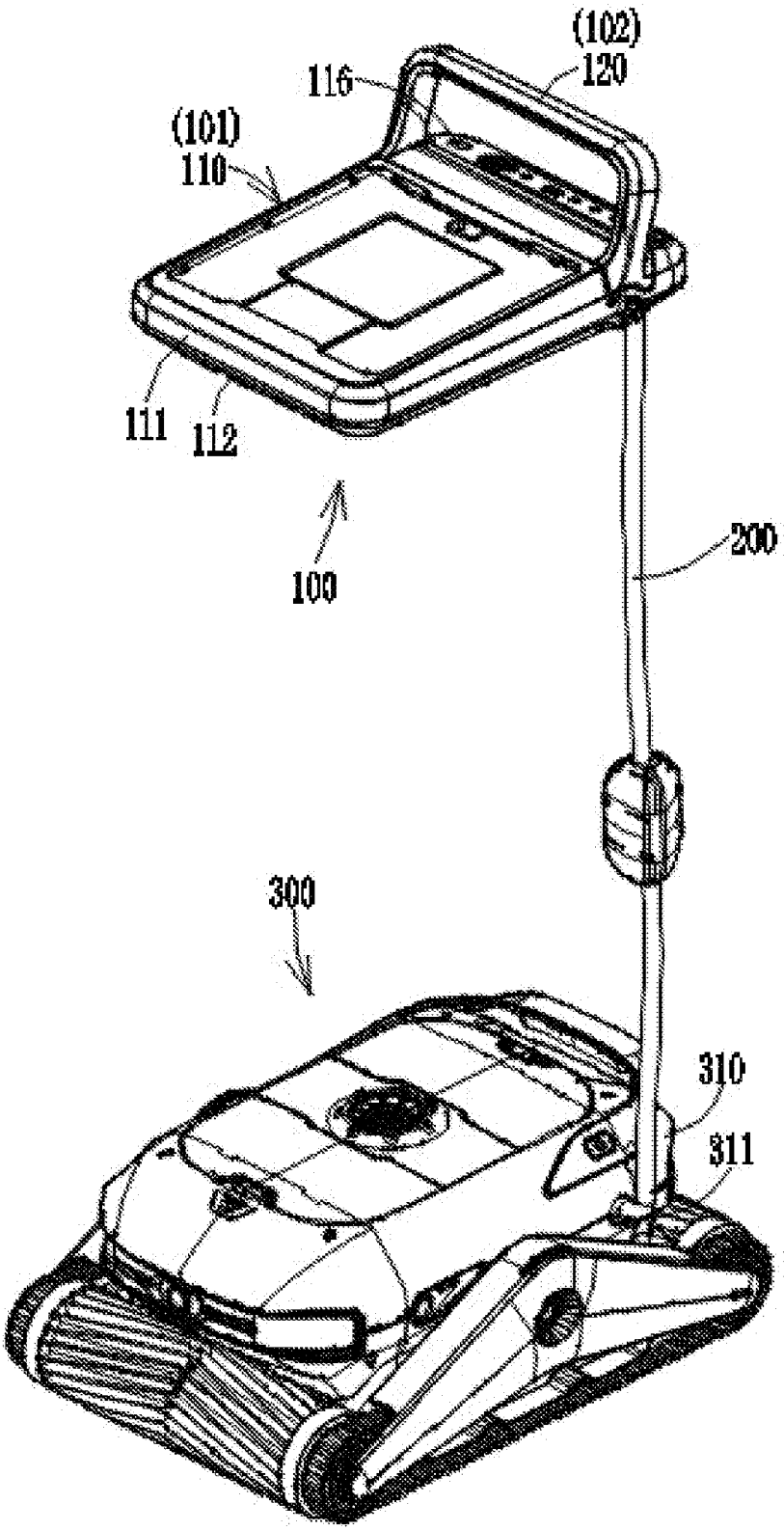
FIG. 1 shows a schematic structural view of a robotic pool cleaner provided in an embodiment of the present disclosure.
Figure 2:
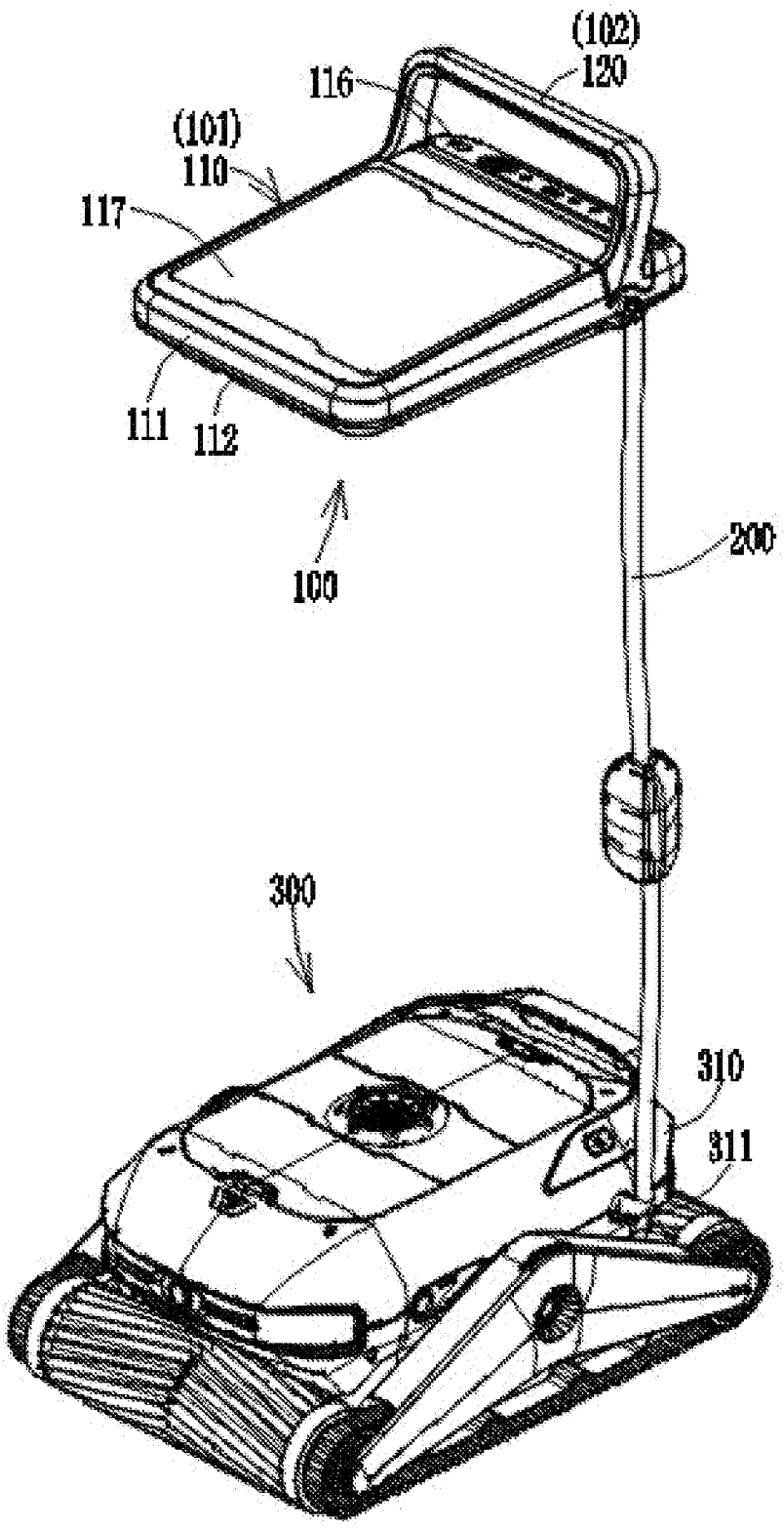
FIG. 2 shows a schematic structural view of the robotic pool cleaner provided in the embodiment of the present disclosure, without the first solar panel shown.
Figure 3:
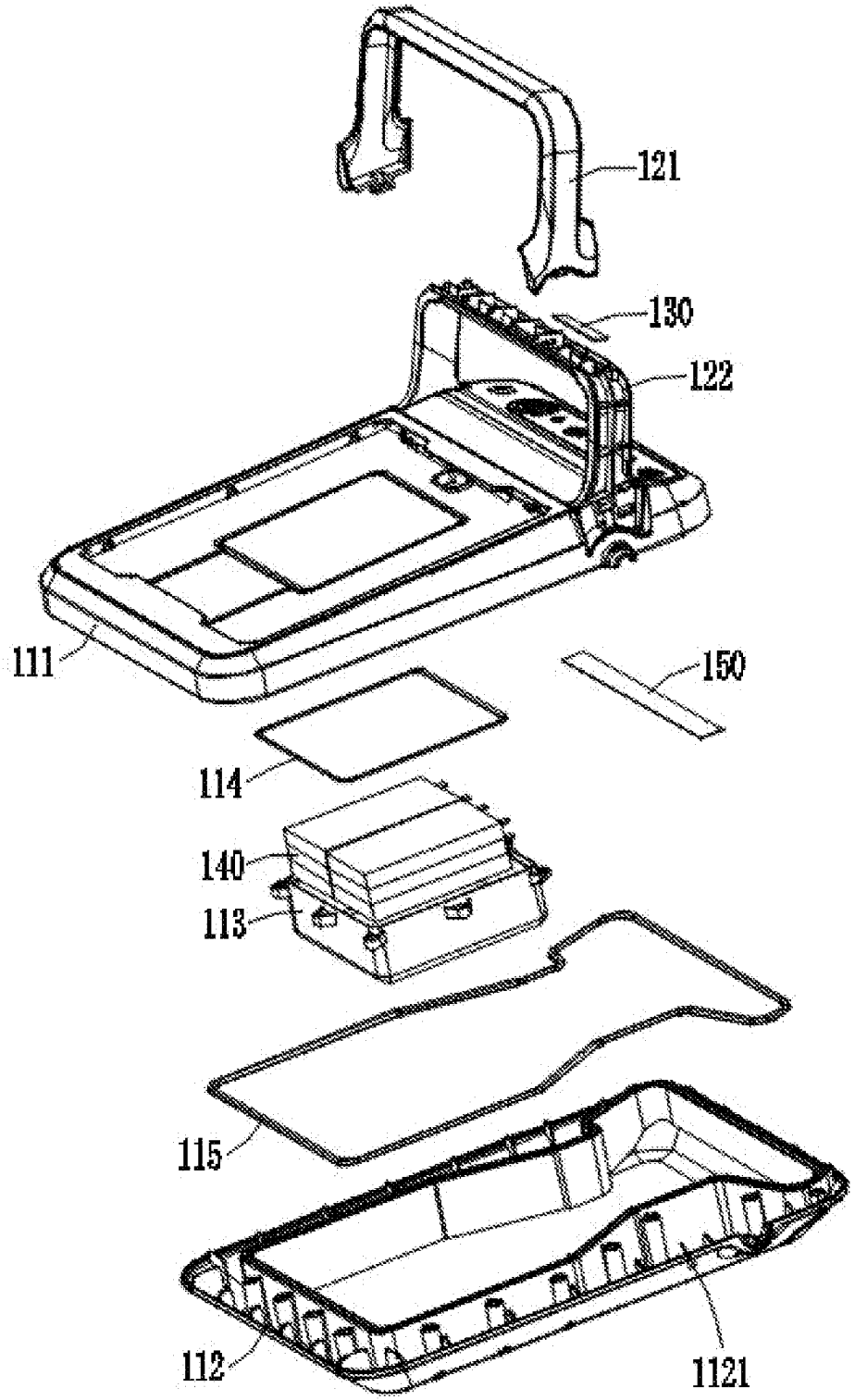
FIG. 3 is an exploded schematic view of the floating device provided by the embodiment of the present disclosure.

In this embodiment, as shown in FIGS. 1-3, the floating device 100 comprises a floating base 101 and a wireless transmission module 130, and the wireless transmission module 130 is packaged in the floating base 101. The arrangement of the wireless transmission module 130 enables the floating device 100 to have a wireless communication function. During the working process of the swimming pool robot, instructions can be transmitted to the wireless transmission module 130 remotely through a remote controller, etc., without redundant cables, and has the advantage of being convenient to use, and there is no dragging of redundant cables, which can improve the work efficiency.

In the embodiment, the floating base 101 has a raised portion 102 protruding from its upper surface, and the wireless transmission module 130 is packaged in the raised portion 102. In this way, the wireless transmission module 130 is located at a higher position relative to the floating base 101, and there are less interference signals around, so the transmission signal strength of the wireless transmission module 130 can be guaranteed as much as possible, thereby ensuring the effectiveness and stability of signal transmission.

In this embodiment, the floating device 100 further comprises a first power supply assembly 140 packaged inside the floating base 101, and the first power supply assembly 140 is electrically connected to the wireless transmission module 130 for power supply.

In this embodiment, the floating base 101 can be arranged as a shell structure, which is called a floating shell 110 here, which comprises a first upper shell 111 and a first chamber shell 113, and the first chamber shell 113 is sealed and fixed on the lower surface of the first upper shell 111, the first power supply assembly 140 is arranged in a sealed chamber surrounded by the first upper shell 111 and the first chamber shell 113.

In this embodiment, the wireless transmission module 130 can be packaged at the top part of the raised portion 102 to ensure that the wireless transmission module 130 is not blocked by other obstacles as much as possible and ensure the effectiveness and stability of signal transmission.

In this embodiment, the top part of the raised portion 102 has a hollow structure, and the wireless transmission module 130 is arranged in the hollow structure at the top end of the raised portion 102. The structure of the raised portion adopts the U-shaped handle structure with the opening facing down as shown in FIGS. 1-3. The hollow structure is located in the middle connection section of the U-shaped handle structure and is higher than the floating base 101 or the floating shell 110, the wireless transmission module 130 is arranged in the hollow structure.

The present disclosure will be further described in detail below in combination with FIGS. 1-5. As shown in FIG. 3, the floating device 100 comprises the floating shell 110 and the wireless transmission module 130, the floating shell 110 is provided with a handle 120, and the top of the handle 120 is higher than the floating shell 110, the wireless transmission module 130 is arranged at the top of the handle 120.

The floating device 100 provided in this embodiment can be easily lifted through the handle 120, and the floating device 100 provided in this embodiment has a wireless communication function, so that instructions can be transmitted remotely to the wireless transmission module 130 through a remote controller or the like, and further to control the moving and working state of the cleaning device 300 of the robotic pool cleaner, thus to realize intelligent planning of cleaning path. For example: the planning of the cleaning path of an irregular-shaped swimming pool, and the working location and working state of the robotic pool cleaner can be known in time, which greatly improves the convenience of use and cleaning efficiency. The wireless transmission module 130 is arranged at the top of the handle 120, which is relatively high relative to the floating shell 110, so there is less interference around, and the signal strength is relatively strong, which can ensure the effectiveness and stability of signal transmission.

More specifically, in this embodiment, the wireless transmission module 130 may be a WIFI module. With this arrangement, the floating device 100 is connected to the Internet, and the robotic pool cleaner can be intelligently controlled through the application program on the control terminal such as a mobile phone, comprising switching on and off, pausing and starting, switching working modes, adjusting light display, and displaying the working state of the machine in real time which comprises working hours, remaining power, moving path, location, etc., thus it is smarter and more convenient. Those skilled in the art know that the wireless transmission module 130 is not limited to WIFI, Bluetooth and ZigBee etc. can also be selected.

Specifically, in this embodiment, as shown in FIG. 3, the floating device 100 further comprises a first power supply assembly 140, the floating shell 110 is provided with a first accommodating chamber (not shown in the figure), and the first power supply assembly 140 is arranged in the first accommodating chamber. With this arrangement, first of all, since the floating device 100 comprises the first power supply assembly 140, a long power cable is not needed by using the floating device 100 provided by this embodiment, thereby effectively avoiding the situation that the cable is entangled and affects the normal work during the operation of the cleaning device 300, furthermore the cumbersome work of accommodating the cable is avoided. Moreover, compared with the first power supply assembly 140 arranged in the cleaning device 300, in this embodiment, the first power supply assembly 140 floats with the floating shell 110 on the water surface, which can reduce the potential safety hazard of water ingress when the first power supply assembly 140 is located underwater, and at the same time the weight of the cleaning device 300 is reduced, thereby reducing the operating power consumption of the cleaning device 300. With the arrangement of the first accommodating chamber for accommodating the first power supply assembly 140 in the floating shell 110, the protection of the first power supply assembly 140 is further improved which further reduces the potential safety hazard of water ingress into the first power supply assembly 140.

Specifically, in this embodiment, the first accommodating chamber can be arranged at the central position of the floating shell 110, so that the first power supply assembly 140 is correspondingly packaged at the central position of the floating base 101 (floating shell 110). Such arrangement can make the center of gravity of the floating device 100 closer to its geometric center, thereby making the floating device 100 more stable when floating on the water surface, and less prone to rollover, which further improves the safety of the first power supply assembly 140 and reduces the potential safety hazard of the first power supply assembly 140.

Specifically, in this embodiment, as shown in FIG. 3, the floating shell 110 comprises a first upper shell 111 and a first chamber shell 113, and the first chamber shell 113 is sealed and fixed on the lower surface of the first upper shell 111, the sealed accommodating chamber enclosed by the first chamber shell and the first upper shell 111 is the first accommodating chamber. With this arrangement, the center of gravity of the floating device 100 is relatively low, so the stability is better, and it is less likely to roll over, which is beneficial to ensure the safety in use.

More specifically, in this embodiment, as shown in FIG. 3, a first sealing ring 114 may be arranged between the first chamber shell 113 and the first upper shell 111, thus to realize waterproofing of the first accommodating chamber.

Specifically, in this embodiment, as shown in FIG. 3, the floating shell 110 further comprises a first lower shell 112, the first lower shell is frame-shaped. The first lower shell 112 surrounds the first chamber shell 113, and is fixedly connected to the first upper shell 111. With this arrangement, the first lower shell 112 and the first upper shell 111 form an annular chamber, which surrounds the first power supply assembly 140, such that the buoyancy around the first power supply assembly 140 is relatively large and is relatively balanced. Therefore, the stability of the floating device 100 can be improved, and further the stability and safety of the first power supply assembly 140 can be improved.

Specifically, in this embodiment, as shown in FIG. 3, the first lower shell 112 is provided with a lower groove 1121, and the inner side of the lower groove 1121 is higher than the outer side of the lower groove 1121, and the inner side of the lower groove 1121 is seal-connected with the first upper shell with the first upper shell 111. With this arrangement, the contact area between the first lower shell 112 and water is relatively large, which facilitates floating and is not easy to sink; the volume of the annular chamber surrounded by the first lower shell 112 and the first upper shell 111 is also relatively large, which can effectively increase the buoyancy, and even if water sweeps through the floating shell 110, the lower groove 1121 can store a certain amount of water, so that other parts at higher positions can be prevented from water ingress; the inner side of the lower groove 1121 is higher than the outer side, so that the inner side can effectively block water seeping into the direction of the first power supply assembly 140, thereby further improving the protection of the first power supply assembly 140 and reducing the safety hazard of water ingress into the first power supply assembly 140.

More specifically, in this embodiment, a second sealing ring 115 may be provided between the inner side of the lower groove 1121 and the first upper shell 111, so as to realize waterproofing of the floating shell 110.

More specifically, in this embodiment, as shown in FIG. 1 and FIG. 3, the floating shell 110 is roughly in the shape of a cuboid, which matches the shape of the first power supply assembly 140. This is beneficial to improving the overall stability of the floating device 100. However, it should be noted that, in other embodiments of the present disclosure, the floating shell 110 is not limited to the above-mentioned shape, but may also be in other shapes, such as a column with an elliptical cross-section.

Specifically, in this embodiment, the chamber with a hollow structure provided in the handle 120 is the second accommodating cavity (not shown in the figure), the second accommodating chamber is higher than the floating shell 110, and the wireless transmission module 130 is arranged inside the second accommodating chamber. With such arrangement, the wireless transmission module 130 is located inside the handle 120 and is protected by the outer shell of the handle 120 so that it is not easily damaged, thereby ensuring normal operation. Obviously, in other embodiments of the present disclosure, the wireless transmission module 130 may not be arranged inside the handle 120, for example: the wireless transmission module 130 may also be arranged outside the handle 120, as long as it is higher than the floating shell 110 thus to ensure signal strength.

Specifically, in this embodiment, as shown in FIG. 3, the handle 120 comprises a second upper shell 121 and a second lower shell 122, the second lower shell 122 is fixedly connected to the floating shell 110, the second upper shell 121 and the second lower shell 122 is fixedly connected and encloses the second accommodating chamber.

More specifically, in this embodiment, as shown in FIG. 3, the handle 120 can be a U-shaped handle, and the second accommodating chamber is located at the middle connection section of the U-shaped handle, with this arrangement, the wireless transmission module 130 is located at the top of the U-shaped handle 120.

It should be noted here that, in this embodiment, the U-shaped handle is arranged at the top of the floating shell 110, and the wireless transmission module 130 is arranged at the top of the U-shaped handle, which facilitates carrying the floating device 100 by hand and ensures the signal strength of the wireless transmission module 130. However, in other embodiments of the present disclosure, the shape of the handle 120 is not limited to the above-mentioned shape, for example: the handle 120 can also be a semicircular handle, as long as it is convenient to lift the floating device 100, and it is convenient to arrange the wireless transmission module 130 at its top thus to ensure the signal strength of the wireless transmission module 130, the specific shapes may not be limited by this disclosure.

Specifically, in this embodiment, the floating device 100 further comprises a first main control board 150, the wireless transmission module 130 is arrange to communicate with the first main control board 150, and the first main control board 150 is connected to the first power supply assembly 140. With this arrangement, the connecting cable 200 can establish a power supply and communication between the floating device 100 and the cleaning device 300; control terminals such as remote controllers or mobile phones exchange data with the wireless transmission module 130, and the wireless transmission module 130 exchanges data with the first main control board 150, and finally control the cleaning device 300 through the first main control board 150.

In this embodiment, the first main control board 150 may be arranged inside the floating base 101. As shown in FIG. 3, the first main control board 150 is arranged inside the floating shell 110.

Specifically, in this embodiment, as shown in FIG. 1, the floating shell 110 is provided with a charging interface 116 configured to charge the first power supply assembly 140. With this arrangement, the first power supply assembly 140 can be charged without being disassembled from the floating device 100, which reduces the adverse effect on the sealing during the disassembly process, and is beneficial to ensure the airtightness of the first accommodation chamber that the first power supply assembly 140 is located; moreover, charging without disassembly may also improve work efficiency and further improve using experience.

In this embodiment, the charging interface 116 is arranged at the upper surface of the floating base 101, as shown in FIG. 1, for example, the charging interface 116 is arranged at the upper surface of the first upper shell 111. With this arrangement, the position of the charging interface 116 is relatively high, so the waterproof performance is good. In addition, the charging interface 116 is arranged at the upper surface of the first upper shell 111, which is convenient for plugging and unplugging the charging device from the upper side. In this embodiment, for the specific arrangement of the charging interface 116, contact or contactless can be adopted, and other ways can also be adopted, which are not limited here, as long as the charging function can be realized.

When the charging interface is contactless, the charging interface can be arranged more flexibly, for instance on the lower surface or side of the floating base.

Preferably, in this embodiment, the upper surface of the floating shell 110 may also be covered with a first solar panel 117. The first solar panel 117 may be electrically connected to the first power supply assembly 140. Therefore, the first solar panel 117 can also charge the first power supply assembly 140. With this arrangement, when the first solar panel 117 has sufficient power, the first solar panel 117 can be preferentially used to charge the first power supply assembly 140 to save energy; when the power of the first solar panel 117 is insufficient, it is charged with the charging interface 116 to ensure that the robotic cleaner can work normally. In other embodiments of the present application, it is also possible to charge only with the charging interface 116 or the first solar panel 117.

This embodiment also provides a robotic pool cleaner. As shown in FIG. 1. The robotic pool cleaner comprises the above-mentioned floating device, and further comprises a cleaning device 300 and a connecting cable 200, the first power supply assembly 140 of the floating device 100 is connected to the cleaning device 300 through the connecting cable 200. The robotic pool cleaner has all the beneficial effects of the above-mentioned floating device, so it will not be repeated here.

Figure 4:
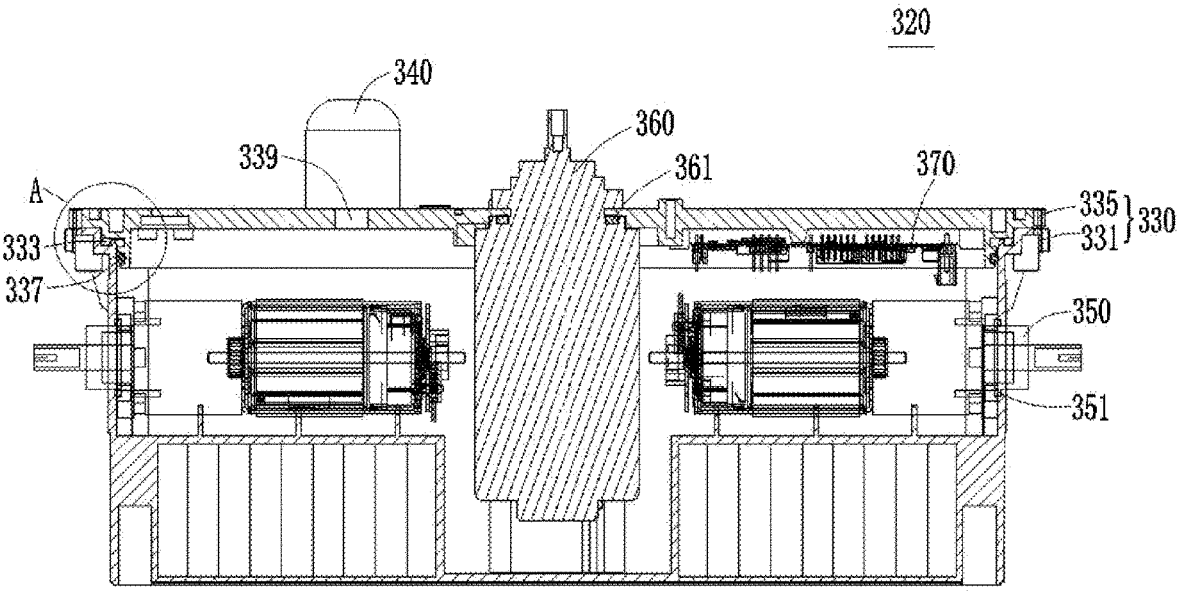
FIG. 4 is a schematic longitudinal sectional view of the motor assembly of the robotic pool cleaner provided in the embodiment of the present disclosure.

Specifically, in this embodiment, as shown in FIG. 4, the cleaning device 300 comprises a cleaning housing 310, and the cleaning housing 310 is provided with a first cable through hole 311; the cleaning housing 310 is provided with a motor assembly 320, and the motor assembly 320 comprises a motor box 330, a walking motor 350 and a water pump motor 360 are arranged in the motor box 330, and the motor box 330 is provided with a second cable through hole 339; the connecting cable 200 passes through the first cable through hole 311 and the second through hole 339 and is connected with the walking motor 350 and water pump motor 360. With this arrangement, by specifically arranging the motor box 330 in the cleaning housing 310, the cleaning housing 310 and the motor box 330 form double protection for each motor. Furthermore, compared with the cleaning housing 310 with relatively large shape and complex structure, by arranging the motor box 330, it is more convenient to ensure the waterproofness of each motor.

Figure 5:
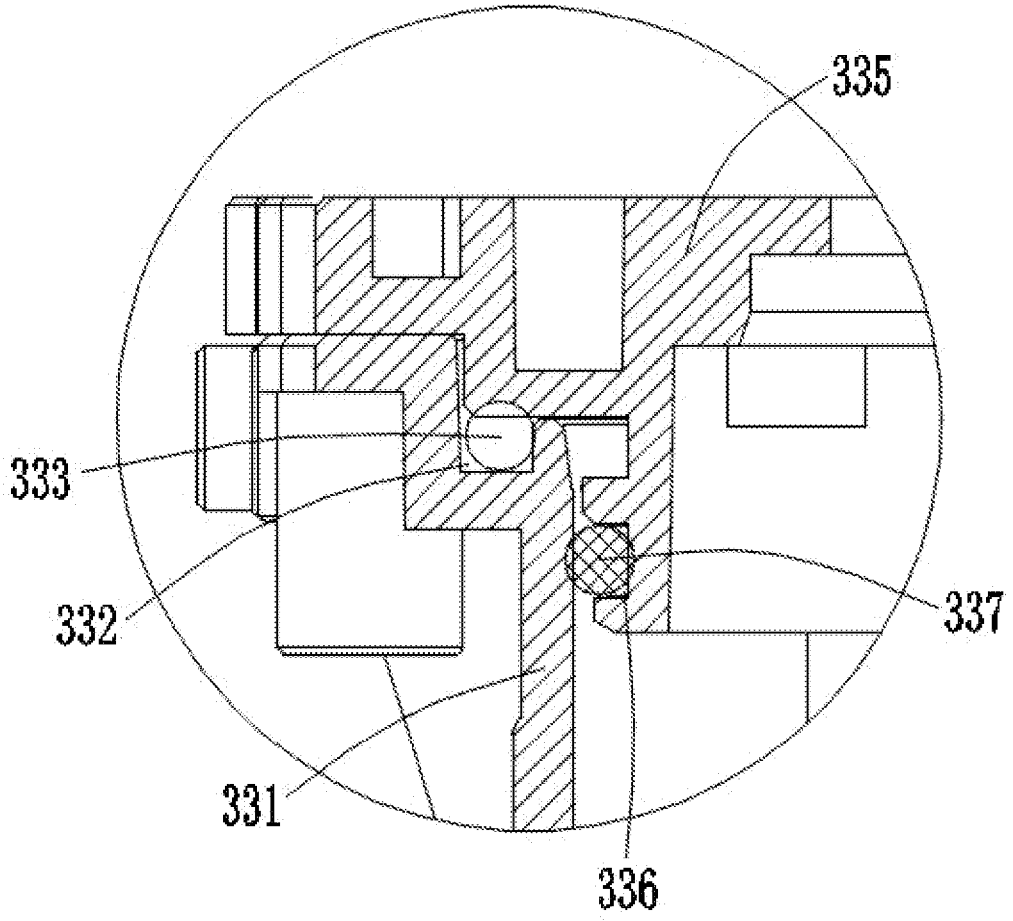
FIG. 5 is an enlarged view of A in FIG. 4.

More specifically, in this embodiment, as shown in FIG. 5, a first receiving groove 332 is arranged on the end surface where the box body 331 is mated with the box cover 335, and the first axial sealing ring 333 is arranged in the first receiving groove 332. In other embodiments of the present application, the first receiving groove 332 may also be arranged on the end surface where the box cover 335 is mated with the box body 331.

More specifically, in this embodiment, as shown in FIG. 5, a second receiving groove 336 is arranged on the circumferential surface where the box cover 335 is mated with the box body 331, and the first axial sealing ring 337 is arranged in the second receiving groove 336. In other embodiments of the present application, the second receiving groove 336 may also be arranged on the circumferential surface where the box body 331 is mated with the box cover 335.

Specifically, in this embodiment, as shown in FIG. 4, a third sealing ring 351 is provided at the joint between the walking motor 350 and the box body 331; a fourth sealing ring 361 is provided vertically at the joint between the water pump motor 360 and the box cover 335.

More specifically, in this embodiment, the sealing ring used above is an O-shaped sealing ring, but the sealing ring used in this application is not limited to the O-shaped sealing ring; in addition, the sealing ring can be made of silica gel, or rubber and other materials with good sealing effect.

Specifically, in this embodiment, as shown in FIG. 4, a fixing joint 340 is arranged at the outside of the second cable through hole 339, configured to fix the connecting cable 200. Optionally, a sealant may be applied between the fixing joint 340 and the motor box 330 to enhance the sealing effect.

Specifically, in this embodiment, as shown in FIG. 4, a second main control board 370 is also arranged in the motor box 330, the connecting cable 200 is connected to the second main control board 370, and the walking motor 350 and the water pump motor 360 are connected to the second main control board 370. With such arrangement, the first main control board 150 and the second main control board 370 can cooperatively control the operation of each motor.

Correspondingly, in this embodiment, as described above for the floating device 100, the charging interface 116 of the robotic pool cleaner can be contact or contactless etc., which is not limited here.

When the charging interface is contactless, the charging interface can be arranged more flexibly, for instance on the lower surface or side of the floating base.

Specifically, in this embodiment, the first power supply assembly 140 can adopt a rechargeable lithium battery in the prior art, and the circuits of the wireless transmission module 130, charging and remote control etc. in the prior art may also be adopted, and will not be repeated here.

The robotic pool cleaner has been exemplified through the above embodiments, wherein some structural features of the above-mentioned floating device 100 have been exemplified. In fact, the floating device 100 of the robotic pool cleaner is not limited to the above structural features, and other structural features may also be used. Another structural feature of the floating device 100 is introduced below, which is renamed as the floating platform 400 for ease of understanding.

Figure 6:
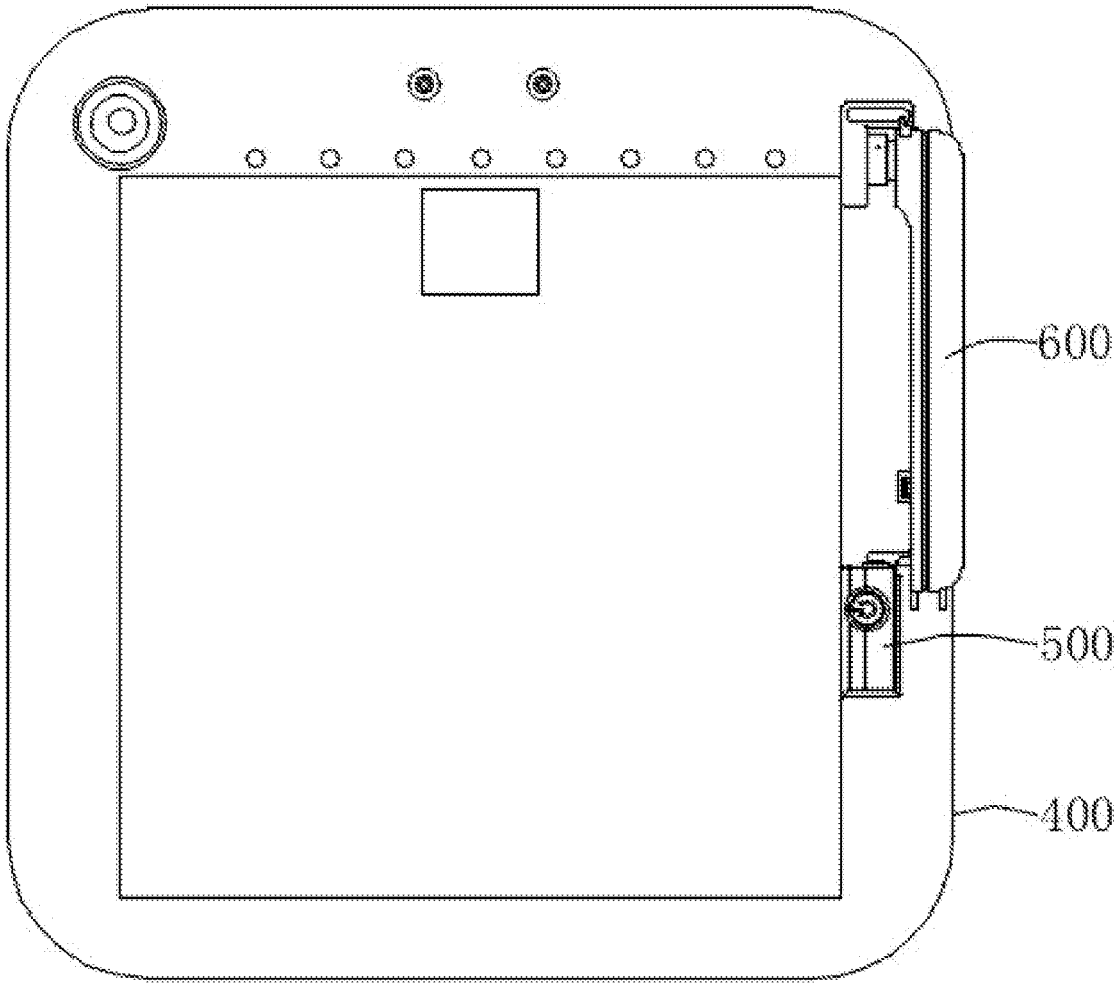
FIG. 6 is a top view of a partial structure of a floating platform provided by the embodiment of the present disclosure.

This embodiment provides a floating platform 400, as shown in FIG. 6, the floating platform 400 comprises a floating body, and a switch assembly 500 and an antenna assembly 600 arranged on the floating body; the switch assembly 500 is configured to control the working state of the electric control system of the floating platform 400, the antenna of the antenna assembly 600 is configured to enhance the strength of the data transceiving signal; the switch assembly 500 is connected with a linkage mechanism, and when the switch assembly 500 is in an open state, the linkage mechanism is connected to the antenna assembly 600 to restrict the antenna being in a retracted state; when the switch assembly 500 is in the closing process, the linkage mechanism can be driven to move to release the restriction of the antenna.

In the floating platform 400 provided in this embodiment, the floating body is provided with a switch assembly 500 and an antenna assembly 600, wherein the antenna of the antenna assembly 600 can enhance the strength of the data transceiving signal, thereby enhancing the stability of remote wireless signal transmission, thereby ensuring the normal operation of the entire device. When the switch assembly 500 is in the open state, the linkage mechanism connected with the switch assembly can restrict the antenna being in the retracted state, so that the antenna is not easy to be damaged or broken. Furthermore, since the antenna is in the retracted state, the floating platform 400 occupies a small space and is convenient for storage. In the closing process, the switch assembly 500 can not only control the working state of the electronic control system to start the electronic control system, but also release the restriction on the antenna through the linkage mechanism, that is, the antenna can be unfolded without additional operations on the antenna, thus the function of the switch assembly 500 is increased and the starting steps of the floating platform 400 are reduced, therefore the problem of the operator forgetting the starting steps is effectively solved, and the starting operation is simple and efficient.

Figure 7:
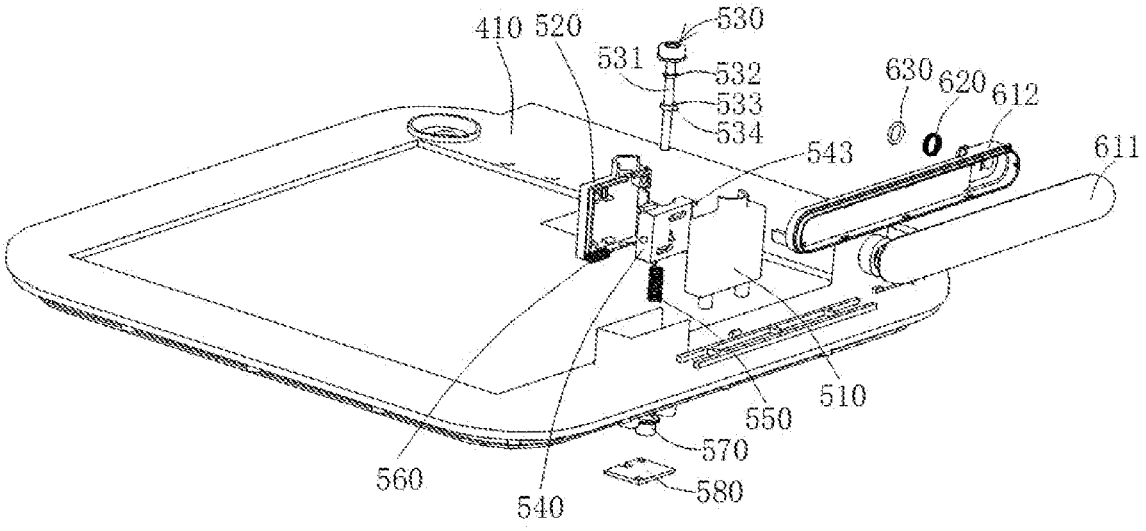
FIG. 7 is a first exploded schematic view of the partial structure of the floating platform provided by the embodiment of the present disclosure.
Figure 8:
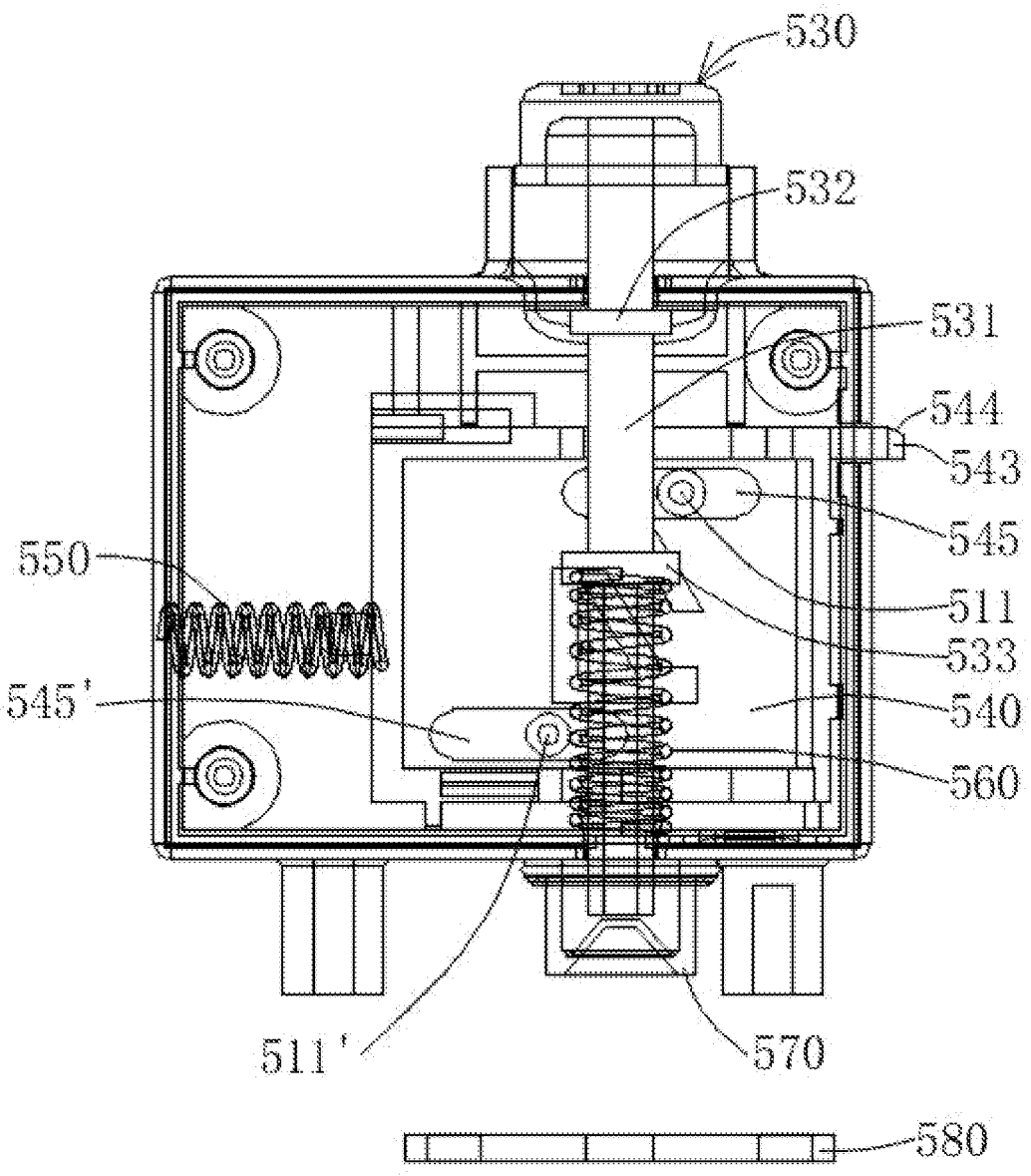
FIG. 8 is a partial side view of the switch assembly and linkage mechanism of the floating platform provided by the embodiment of the present disclosure.

Specifically, in this embodiment, as shown in FIG. 7 and FIG. 8, the antenna assembly 600 comprises an elastic member, which acts between the floating body and the antenna, and makes the antenna always have a tendency to expand; the linkage mechanism comprises a first stopper 543, the first stopper 543 is configured to restrict the antenna in the retracted state; the switch assembly 500 comprises a movable part 530 provided with a movable contact, and the movable part 530 can drive the linkage mechanism to move during the closing process of the switch assembly 500, so that the first stopper 543 is detached from the antenna, and the antenna can be expanded under the action of the elastic member. With this arrangement, when the switch assembly 500 is closed, the movable part 530 is operated, and the movable contact on the movable part 530 can start the electric control system, and the movable part 530 also drives the linkage mechanism to move, so that the first stopper 543 is detached from the antenna, so that the antenna is no longer limited by the first stopper 543, but is expanded under the action of the elastic member.

Figure 9:
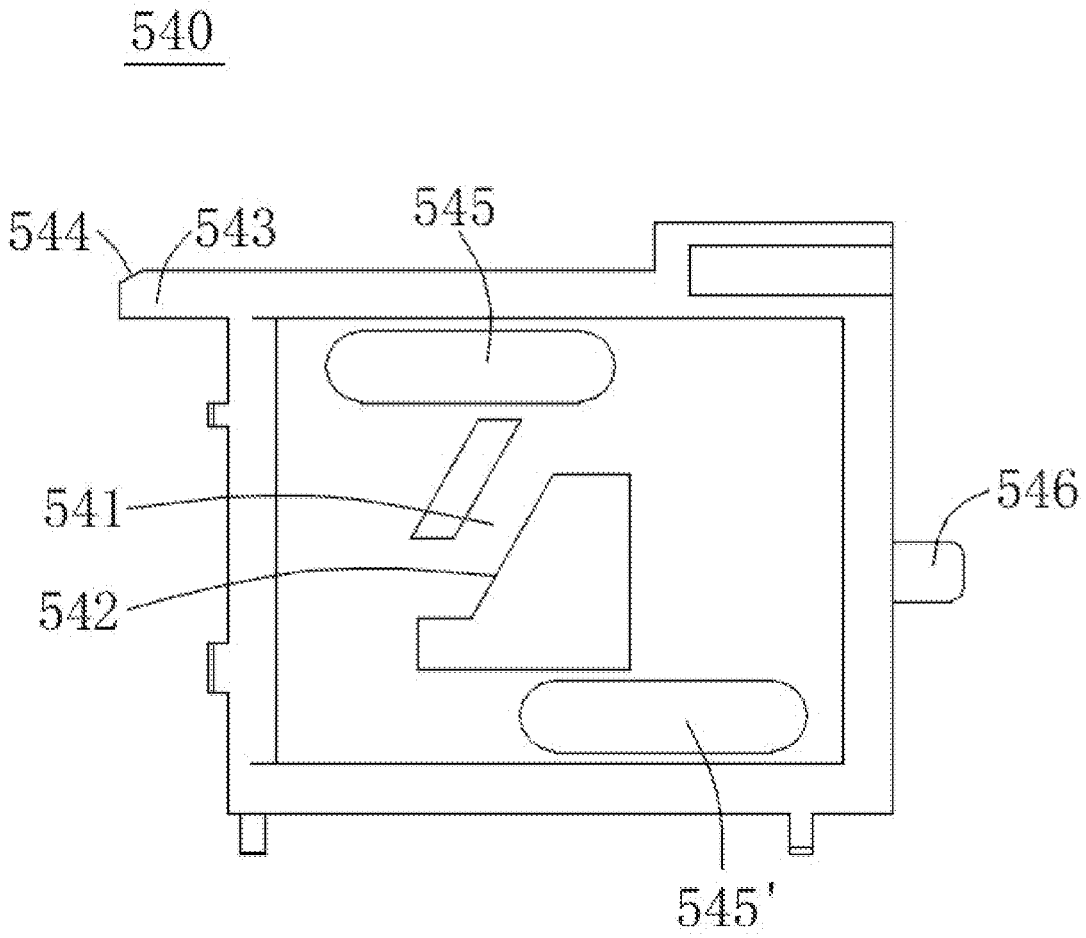
FIG. 9 is a rear view of the slider of the floating platform provided by the embodiment of the present disclosure.

Specifically, in this embodiment, as shown in FIG. 8 and with reference to FIG. 9, the linkage mechanism further comprises a driving part and a linkage part, the driving part is fixedly arranged at the movable part 530, and the first stopper 543 is fixedly arranged at the linkage part, the linkage part has a guiding surface 542; during the closing process of the switch assembly 500, the driving part abuts against the guiding surface 542, and can move along the guiding surface 542 to push the linkage part to move, so that the moving direction of the movable part 530 and the moving direction in which the first stopper 543 is detached from the antenna form an angle. With this arrangement, with the help of the guiding effect of the guiding surface 542 at the linkage part, the moving direction of the movable part 530 is arranged to be different from the moving direction in which the first stopper 543 is detached from the antenna, so that the movable part 530 can be arranged in a location which is easy for operation.

It should be noted that, in this embodiment, the moving direction of the movable part 530 and the moving direction of the first stopper 543 form an angle, however, in other embodiments of the present application, the moving direction of the movable part 530 can also be consistent with the moving direction of the first stopper 543, for example, the movable part 530 is fixedly connected with the first stopper 543, and during the closing process of the switch assembly 500, the moving direction of the movable part 530 is consistent with the moving direction in which the first stopper 543 is detached from the antenna. With such arrangement, the component number of the linkage mechanism is small, and the structure is simpler, which is convenient for manufacturing.

Figure 13:
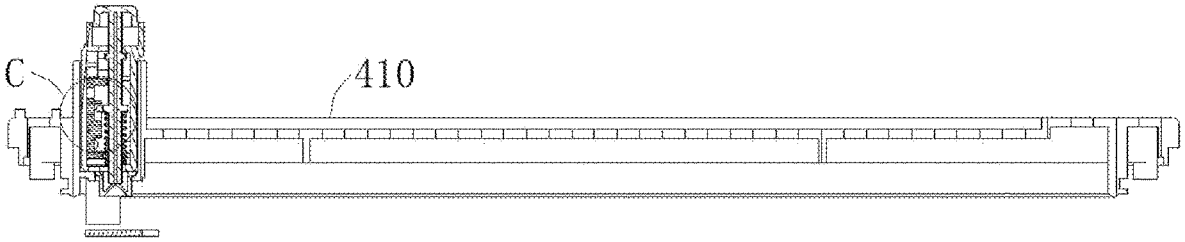
FIG. 13 is a second schematic side sectional view of the partial structure of the floating platform provided by the embodiment of the present disclosure.
Figure 14:
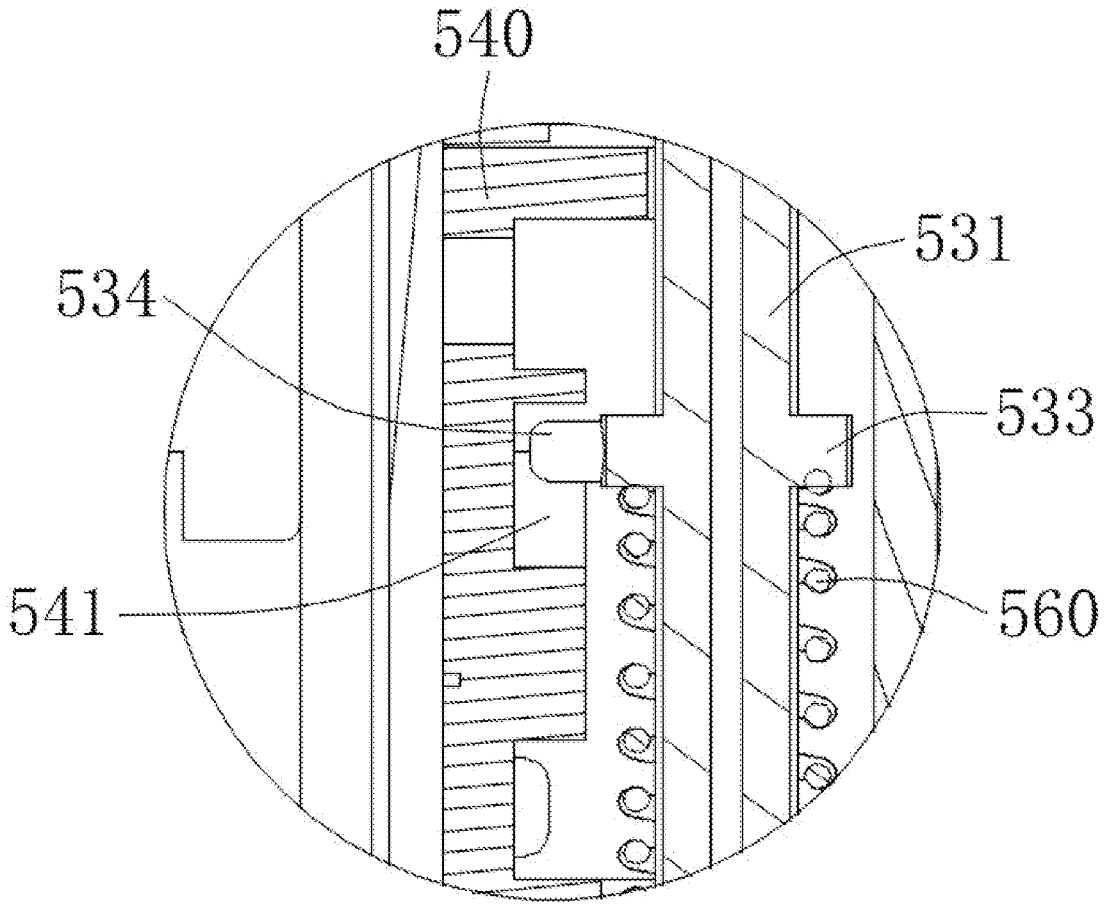
FIG. 14 is an enlarged view of C in FIG. 13.

Specifically, in this embodiment, as shown in FIG. 7 and FIG. 8, and in combination with FIG. 9, FIG. 13 and FIG. 14. The switch assembly 500 further comprises a switch box, and the movable part 530 is arranged in the switch box, and the operating part of the movable part 530 is exposed. The linkage part is a slider 540, the first stopper 543 is fixedly arranged on the slider 540, the slider 540 is arranged in the switch box, and can move along the moving direction in which the first stopper 543 is detached from the antenna; when the antenna is in the retracted state, the first stopper 543 extends out of the switch box and is connected with the antenna; the movable part 530 has a driving protrusion 534 protruding from its outer wall to form the driving part; the slider 540 is provided with a sliding slot 541, and the sliding slot 541 is configured, together with a groove wall against which the driving protrusion 534 abuts to form a guiding surface 542, and the driving protrusion 534 is arranged in the sliding slot 541. During the closing process of the switch assembly 500, the driving protrusion 534 can move along the sliding slot 541, and push the slider 540 to move along the direction that the first stopper 543 is detached from the antenna. With this arrangement, when the switch assembly 500 is closed, the movable part 530 is operated, and while the movable part 530 moves along its moving direction, the driving protrusion 534 on it moves along the sliding slot 541 of the slider 540, thereby pushing the slider 540 to move through the guiding surface 542 in the sliding slot 541, and further driving the first stopper 543 to be detached from the antenna.

Specifically, in this embodiment, as shown in FIG. 8, the inner wall of the switch box is provided with at least one guiding column, and the slider 540 is provided with at least one guiding slot, and the guiding slot is arranged to extend along the moving direction of the first stopper 543. The guiding column is correspondingly plugged into the guiding slot. With this arrangement, the cooperation of the guiding column and the guiding slot forms a limiting and guiding function on the slider 540, so that the slider 540 can only move along the moving direction of the first stopper 543.

More specifically, in this embodiment, as shown in FIG. 8, the inner wall of the switch box is provided with two guiding columns, which are respectively the first guiding column 511 and the second guiding column 511'. The slider 540 is provided with two guiding grooves, which are respectively the first guiding groove 545 and the second guiding groove 545', and the two guiding slots are extended along the moving direction of the first stopper 543; the first guiding column 511 is plugged into the first guiding groove 545, and the second guiding column 511' is plugged into the second guiding groove 545'.

More specifically, as shown in FIG. 9, the axes of the two guiding slots along the longitudinal direction are parallel to each other and not collinear.

It should be noted that, in other embodiments of the present application, the arrangement of the guiding column and guiding slot such as the position, the number and corresponding relationship etc. are not limited to the above-mentioned forms. For example: the slider 540 is provided with four guiding columns, and the inner wall of switch box is provided with two guiding slots, and the guiding slots both extend along the moving direction of the first stopper 543, and the two guiding columns are correspondingly plugged into one guiding slot. That is, as long as the slider 540 can be restricted so that it can only move along the moving direction of the first stopper 543, the present application does not limit the specific arrangement of the guiding mechanism formed by the guiding column and the guiding slot.

Specifically, in this embodiment, as shown in FIG. 8, the movable part 530 is a pressing type, and the pressing position of the movable part 530 is exposed above the floating body shown, and the movable part 530 can move vertically. The first stopper 543 can move along the horizontal direction. With this arrangement, the pressing position of the movable part 530 is relatively high, and it is not easy for water ingress, and it is also convenient for the operator to press the movable part 530 downward.

What needs to be explained here is that in other embodiments of the present application, the movable part 530 can also be a toggle type, the toggle position of the movable part 530 is exposed on the side of the floating body, and the movable part 530 can be moved vertically. The first stopper 543 can move in the horizontal direction.

It should also be noted that, in this embodiment, the moving direction of the movable part 530 and the moving direction of the slider 540 substantially form a right angle, and the length of the guiding slot extends along the horizontal direction. However, in other embodiments of the present application, the angle between the two moving directions can also be other angles, for example: two motion directions form an angle of 60°, specifically, the length of the guiding slot can be arranged to extend in a direction forming an angel of 30° with the horizontal plane. The moving direction of the movable part 530 can also be changed.

Specifically, in this embodiment, a chamfer 544 is provided on the upper side of the end of the first stopper 543, which is configured to guide the antenna when the antenna is pressed under the first stopper 543.

Specifically, in this embodiment, as shown in FIG. 8, the linkage mechanism further comprises a first reset element 550. The first reset element 550 is arranged in the switch box and connected between the inner wall of the switch box and the slider 540. The slider 540 is reset along the direction opposite to the moving direction when the first stopper 543 is detached from the antenna. With this arrangement, when the first stopper 543 is detached from the antenna, the antenna is unfolded, and the slider 540 is reset under the action of the first reset element 550 so as to retract the antenna again.

More specifically, in this embodiment, the first reset element 550 is a first compression spring, and the first compression spring is arranged on one side of the slider 540 away from the first stopper 543, and the axial direction is along the moving direction of the slider 540. It is provided that the first compression spring makes the slider 540 always have a tendency to move in the direction opposite to the moving direction in which the first stopper 543 is detached from the antenna. In other embodiments of the present application, the first reset element 550 can also be a first tension spring, and the first tension spring and the first stopper 543 are located on the same side of the slider 540 and axially arranged in the moving direction of the slider 540, and the first tension spring makes the slider 540 always have a tendency to move in the opposite direction of the moving direction in which the first stopper 543 is detached from the antenna.

Optionally, in this embodiment, as shown in FIG. 9, the side wall of the slider 540 may be provided with a mounting column 546, one end of the first compression spring is fixedly sleeved on the mounting column 546, and the other end abuts against the inner wall of the switch box. In other embodiments of the present application, the side wall of the slider 540 may also be provided with a mounting groove configured to fix the end of the first compression spring; the inner wall of the switch box may also be provided with a structure such as a mounting column or a mounting groove etc. configured to fix the end of the first compression spring.

Specifically, in this embodiment, as shown in FIG. 8, the switch assembly 500 further comprises a second reset element 560, the second reset element 560 is arranged in the switch box and connected between the inner wall of the switch box and the movable part 530, and configured to reset the movable part 530 in a direction opposite to the moving direction in which the switch assembly 500 closes. With this arrangement, when the electronic control system is activated and the antenna is unfolded, the movable part 530 is released, and the movable part 530 can be reset under the action of the second reset element 560.

More specifically, in this embodiment, the second reset element 560 is a second compression spring, and the second compression spring is arranged at one end of the movable part 530 close to the movable contact, and is arranged axially along the moving direction of the movable part 530. The second compression spring makes the movable part 530 always have a tendency to move in a direction opposite to the moving direction in which the switch assembly 500 is closed. In other embodiments of the present application, the second reset element 560 can also be a second tension spring, and the second tension spring is arranged at the end of the movable part 530 away from the movable contact, and arranged axially along the moving direction of the movable part 530. The second tension spring makes the movable part 530 always have a tendency to move in the opposite direction to the moving direction when the switch assembly 500 is closed.

Specifically, in this embodiment, as shown in FIG. 8 and with reference to FIG. 7, the movable part 530 is rod-shaped, comprising a main body 531 and a first limit ring 532 and a second limit ring 533 arranged thereon from top to bottom.

When the switch assembly 500 is in the open state, the first limit ring 532 abuts against the inner wall of the switch box; the driving protrusion 534 is arranged on the second limit ring 533, and the second compression spring is sleeved on the main body 531 and located between the second limit ring 533 and the inner wall of the switch box.

Specifically, in this embodiment, as shown in FIG. 7 and FIG. 8, the switch box comprises a first front cover 510 and a first rear cover 520, both of which are fixedly connected to form an accommodating chamber, the movable part 530, the first reset element 550, the slider 540 and the second reset element 560 are all arranged in the accommodating chamber.

In this embodiment, as shown in FIG. 7, the switch assembly 500 further comprises a silicone element 570, the electric control system of the floating platform 400 comprises a first electric control board 580, both of which are arranged on the floating body, and the movable contact of the movable part 530 moves downwards, presses the first electric control board 580 through the silicone element 570, and starts the electric control system.

Figure 10:
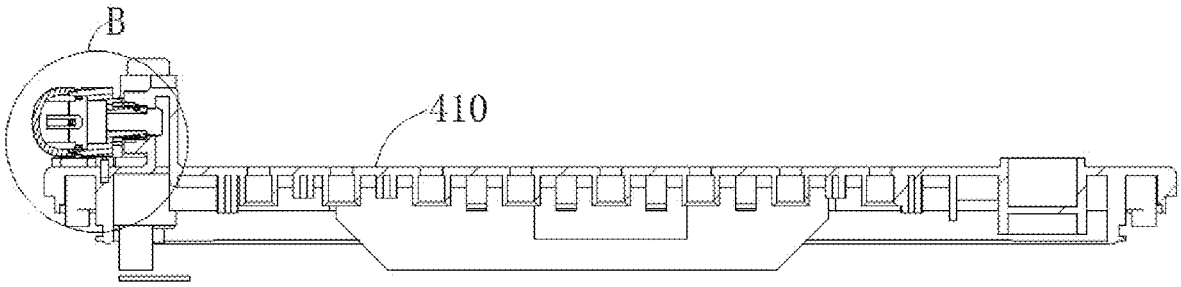
FIG. 10 is a first side cross-sectional view of the partial structure of the floating platform provided by the embodiment of the present disclosure.
Figure 11:
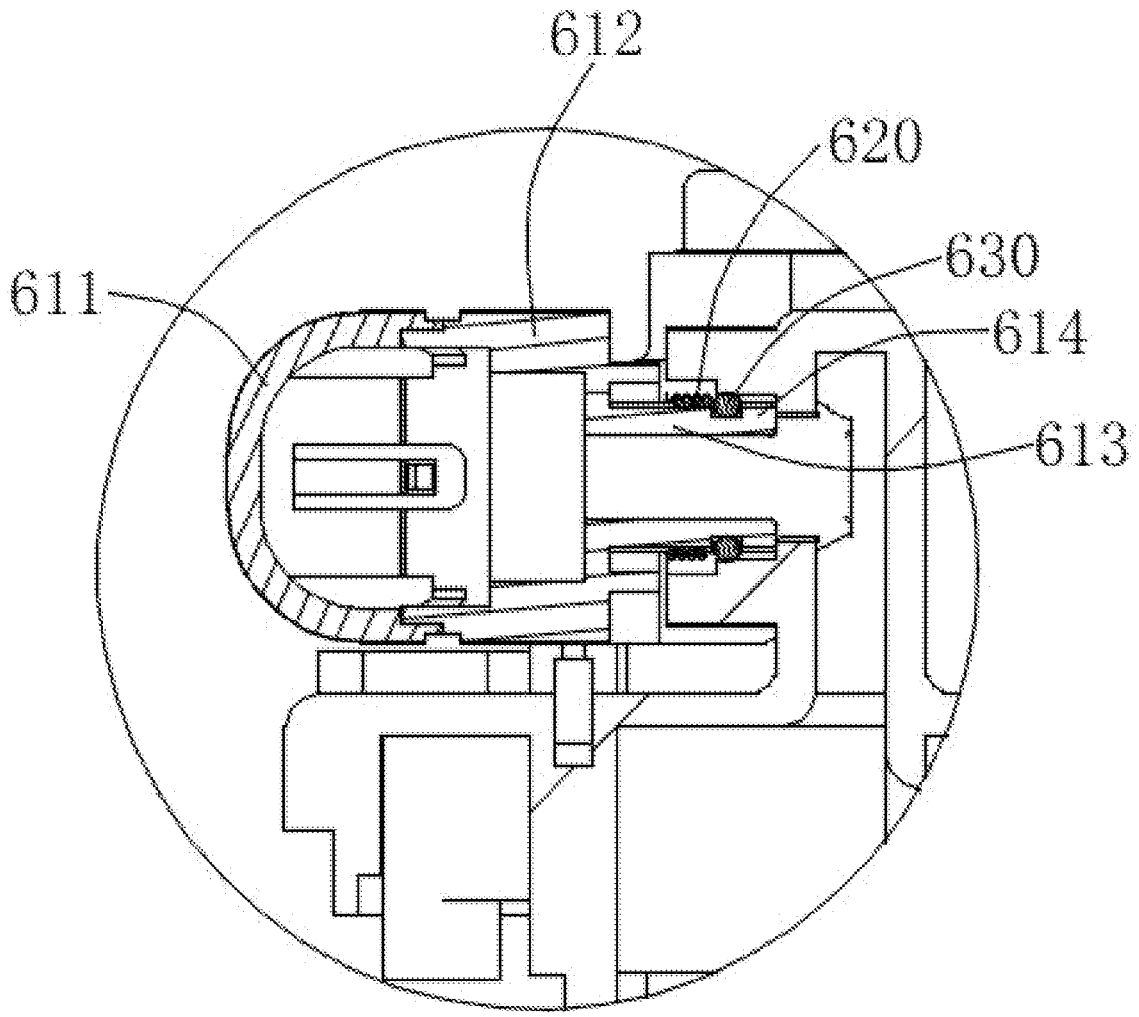
FIG. 11 is an enlarged view of B in FIG. 10.

Specifically, in this embodiment, as shown in FIG. 10 and FIG. 11, the antenna is rotatably arranged on the floating body, the elastic member of the antenna assembly 600 is a torsion spring 620, and the torsion spring 620 is connected between the floating body and the antenna, and the torsion spring 620 makes the antenna always have a tendency to rotate and bounce to an unfolded state. With this arrangement, when the first stopper 643 is detached from the antenna, the torsion spring 620 makes the antenna rotate and bounce to a vertically unfolded state.

What needs to be noted here is that in other embodiments of the present application, the antenna is not limited to the above arrangements. For example, the antenna can also be telescopically mounted on the floating body. The elastic element of the antenna assembly 600 makes the telescopic part of the antenna always have a tendency to expand in a vertical direction.

Figure 12:
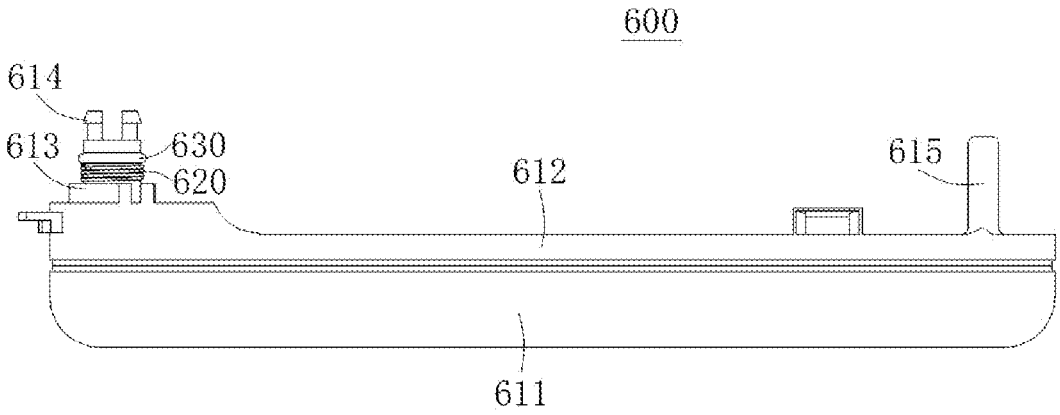
FIG. 12 is a schematic structural view of an antenna assembly of the floating platform provided by the embodiment of the present disclosure.

Specifically, in this embodiment, as shown in FIG. 12, the antenna is provided with a second stopper 615, and the second stopper 615 cooperates with the linkage mechanism so that the antenna is in a retracted state. More specifically, when the antenna is retracted, the second stopper 615 abuts against the first stopper 543, and the first stopper 543 restricts the rotation and expansion of the antenna by blocking the second stopper 615.

Specifically, in this embodiment, as shown in FIG. 12, one end of the antenna along its axial direction is connected to the floating body, and the second stopper 615 is arranged at the other end of the antenna along its axial direction. With this arrangement, it can be seen from the principle of leverage that the force required for the first stopper 543 to block the second stopper 615 is relatively small, so that the interaction force between the first stopper 543 and the second stopper 615 is relatively small, thereby neither is easily damaged.

More specifically, in this embodiment, as shown in FIG. 12, the second stopper 615 is a blocking plate. In other embodiments of the present application, the second stopper 615 is not limited to the above-mentioned arrangements, for example, the second stopper 615 may also be a limiting rod or the like. As long as it can abut against the first stopper 543 and be blocked by the first stopper 543 so that the antenna is in a retracted state, the present application does not limit the specific structure of the second stopper 615.

Specifically, in this embodiment, as shown in FIG. 12, a rotating shaft 613 is provided at one end of the rotating connection between the antenna and the floating body, the torsion spring 620 is sleeved outside the rotating shaft 613, and the end of the rotating shaft 613 away from the main body of the antenna is provided with a chuck 614, the floating body is provided with a snap-in slot, and the chuck 614 is clamped in the snap-in slot of the floating body, and a sealing ring 630 is also provided between the chuck 614 and the snap-in slot to prevent water ingress between the snap-in slot and the chuck 614.

Specifically, in this embodiment, as shown in FIG. 7 and FIG. 12, the main body of the antenna comprises a second front cover 611 and a second rear cover 612, and a second electric control board (not shown) is arranged in the chamber surrounded by the two covers (not shown), that is, the electric control board of the antenna.

Figure 15:
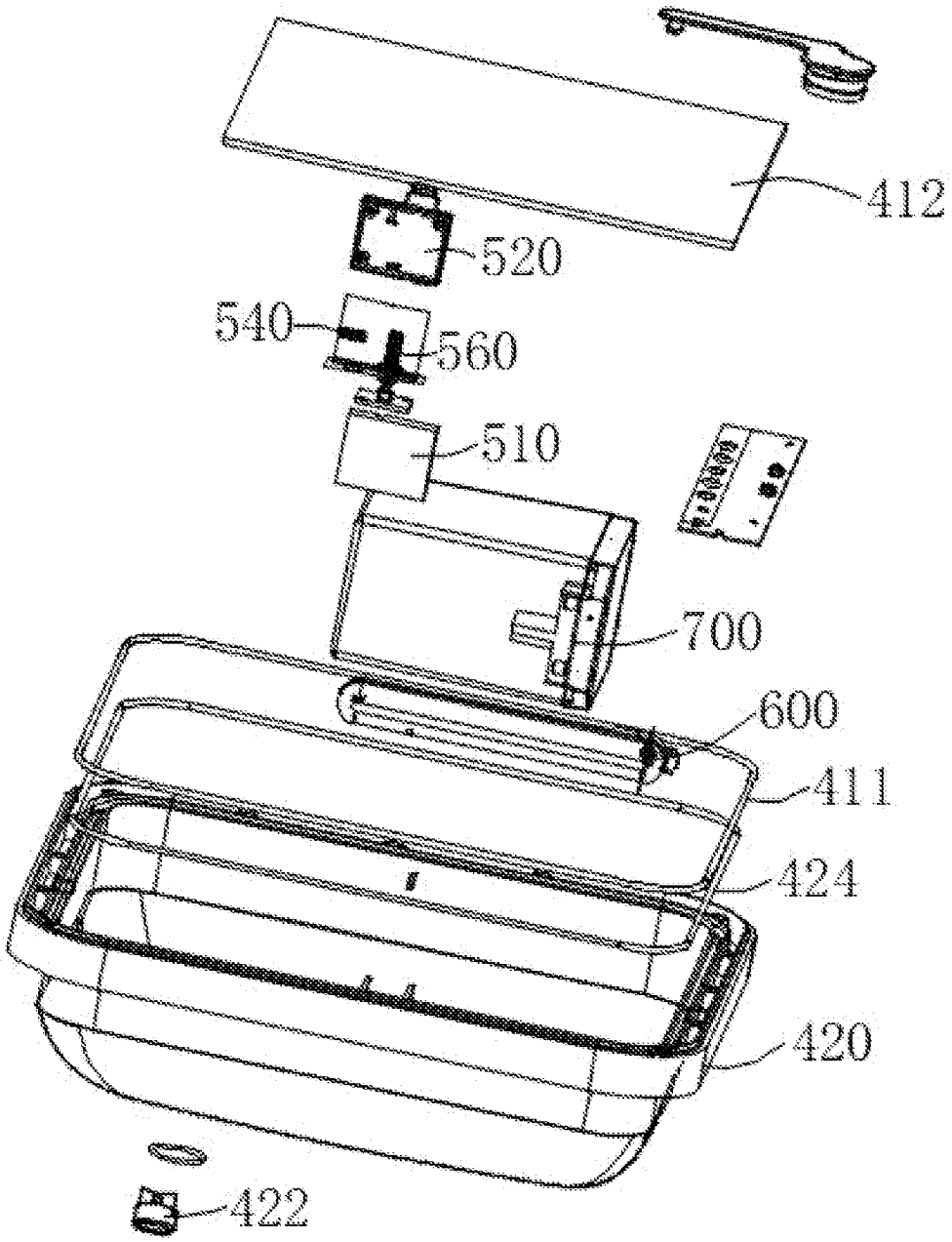
FIG. 15 is a second exploded schematic view of the partial structure of the floating platform provided by the embodiment of the present disclosure.
Figure 16:
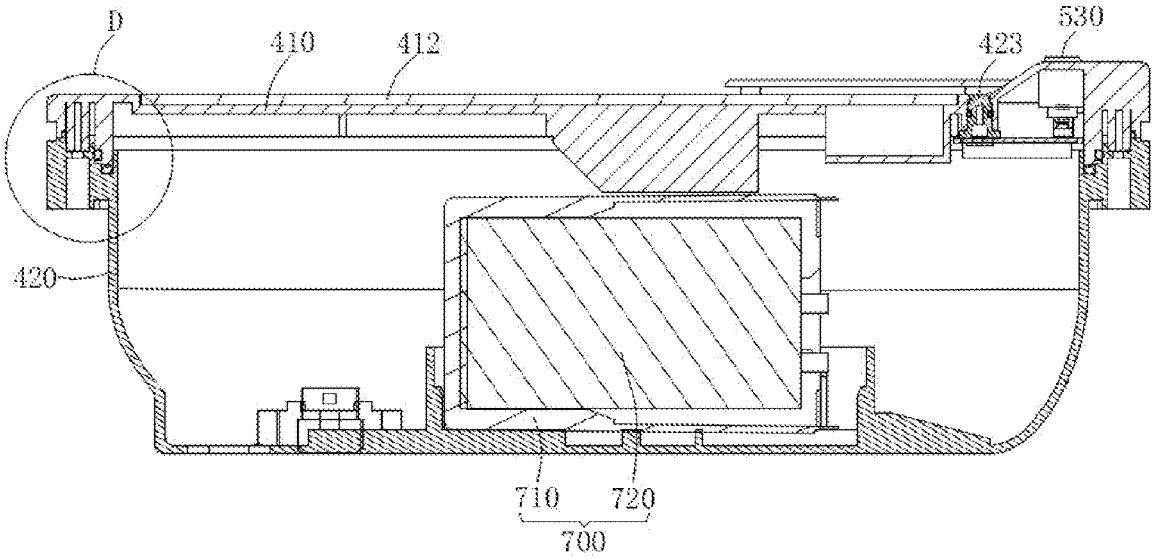
FIG. 16 is a third schematic side sectional view of the partial structure of the floating platform provided by the embodiment of the present disclosure.

Specifically, in this embodiment, as shown in FIG. 15 and FIG. 16, the floating platform 400 further comprises a housing and a second power supply assembly 700, and the second power supply assembly 700 is arranged in the housing and is located at the geometric center of the bottom. With this arrangement, the center of gravity of the floating platform 400 is located at its bottom. Using the principle that the lower the center of gravity of an object, the more stable it is. When the floating platform 400 is in an upright state, the center of gravity is the lowest, which improves the stability of the floating platform 400. Specifically, the second power supply assembly 700 comprises a battery box 710 and a battery pack 720 packaged in the battery box 710.

Specifically, in this embodiment, the second power supply assembly 700 is connected to the cleaning device through a cable, and the cable connector 422 is arranged on the geometric central axis of the lower housing 420. With this arrangement, when receiving the traction force of the underwater cleaning device forward, backward, to the left and to the right, it can well avoid rollover and sinking.

Specifically, in this embodiment, as shown in FIG. 15 and FIG. 16, the outside of the bottom of the housing is arc-shaped. More specifically, the outer side of the housing bottom is similar to a hemispherical arc surface. When the floating platform 400 tilts to one side, the fulcrum of the floating platform 400 on the water surface, that is, the contact surface between the outer bottom of the floating platform 400 housing and the water surface, will also change correspondingly. At this time, the floating platform 400 will swing back to its original position under the action of gravity, so that it will not roll over.

Figure 17:
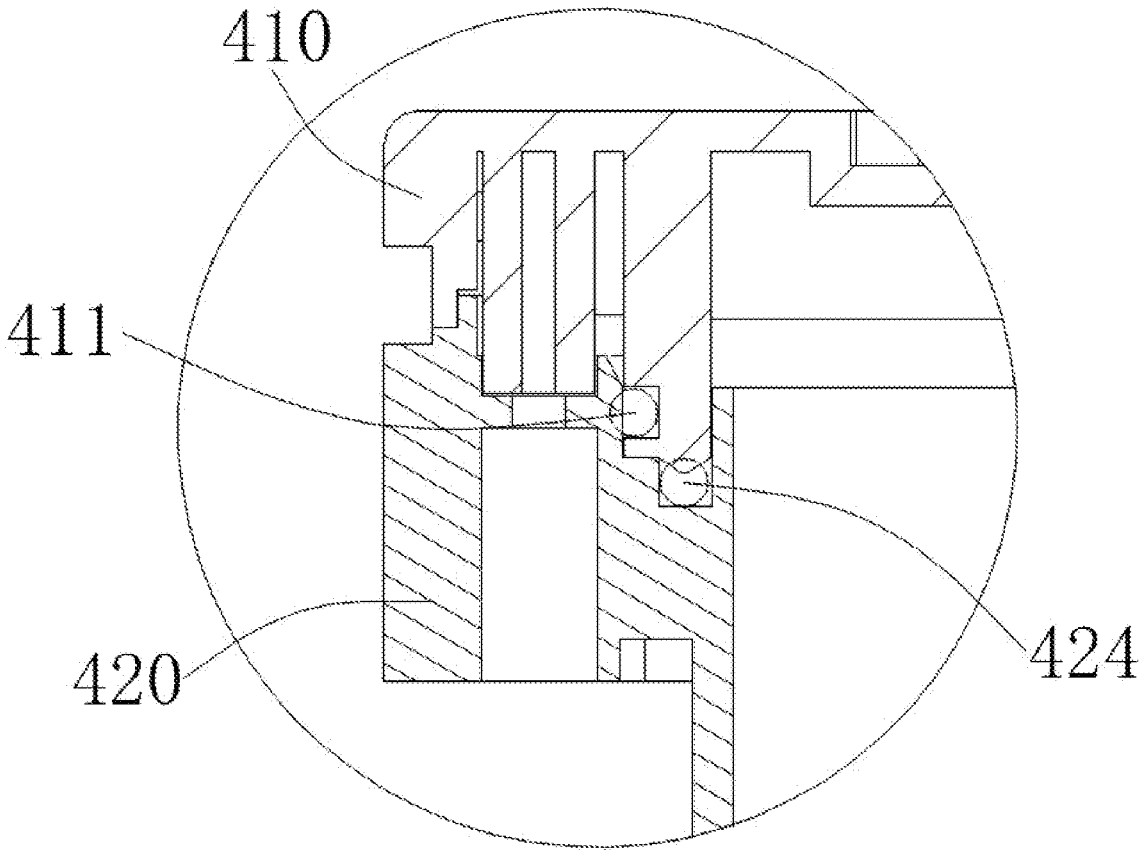
FIG. 17 is an enlarged view of D in FIG. 16.

Specifically, in this embodiment, as shown in FIG. 16 and FIG. 17, the housing comprises an upper cover 410 and a lower housing 420, both of which are fixedly fastened together. Furthermore, a second radial sealing ring 411 is provided in the lateral recess of the upper cover 410, a second axial seal ring 424 is provided at the double seam of the lower housing 420, and the double seal makes the shell more waterproof.

Specifically, in this embodiment, as shown in FIG. 15 and FIG. 16, the floating platform 400 further comprises a second solar panel 412, the second solar panel 412 is arranged on the top of the floating body, the second solar panel 412 is connected with the second power supply assembly 700 and is configured to charge the second power supply assembly 700. Preferably, the second solar panel 412 is arranged at the geometric center of the upper surface of the upper cover 410 of the floating platform 400. With this arrangement, the center of gravity of the second solar panel 412 and the center of gravity of the entire floating body are in a straight line, and the stability of the floating platform 400 is better.

Specifically, in this embodiment, the floating platform 400 may also be provided with a charging interface configured to charge the second power supply assembly 700. With this arrangement, when charging the second power supply assembly 700, the second solar panel 412 can be preferred for charging, which can not only save energy and reduce costs, but also work while be charged; and when the second solar panel 412 does not have enough power to meet the power supply requirement of the second power supply assembly 700, the second power supply assembly 700 can be charged through the charging interface.

In this embodiment, as for the specific arrangement of the charging interface, a contact type or contactless type can be adopted, and other methods can also be adopted, which are not limited here, as long as the charging function can be realized.

This embodiment also provides a robotic pool cleaner, which comprises the above-mentioned floating platform 400. The robotic pool cleaner has all the advantages of the above-mentioned floating platform 400, so details will not be repeated here.

Correspondingly, the charging interface of the robotic pool cleaner can be a contact type or a contactless type, etc., which is not limited here.

Although the present application is disclosed as above, the present application is not limited thereto. Any person skilled in the art can make various changes and modifications without departing from the spirit and scope of the present application. Therefore, the protection scope of the present application should be based on the scope defined in the claims.

Finally, it should also be noted that in this disclosure, relational terms such as first and second etc. are only used to distinguish one entity or operation from another, and do not necessarily require or imply that any such actual relationship or order exists between these entities or operations. Furthermore, the terms "include", "comprise" or any other variation thereof is intended to cover a non-exclusive inclusion such that a process, method, object, or apparatus comprising a set of elements includes not only those elements, but also includes elements not expressly listed or other elements inherent in such a process, method, object, or apparatus. Without further limitations, an element defined by the phrase "comprising a . . . " does not exclude the presence of additional identical elements in the process, method, object or apparatus.

Each embodiment in this specification is described in a progressive manner, each embodiment focuses on the difference from other embodiments, and the same and similar parts of each embodiment can be referred to each other.

The above description of the disclosed embodiments is provided to enable any person skilled in the art to make or use the present application. Various modifications to these embodiments will be readily apparent to those skilled in the art, and the general principles defined herein may be implemented in other embodiments without departing from the spirit or scope of the application. Therefore, the present application will not be limited to the embodiments shown herein, but is to be accorded the widest scope consistent with the principles and novel features disclosed herein.

INDUSTRIAL APPLICABILITY

The floating device and the robotic pool cleaner provided by the embodiment of the present application have unlimited communication functions, so that instructions can be transmitted remotely to the wireless transmission module through a remote controller, etc., and then the walking and working status of the cleaning device of the robotic pool cleaner can be controlled, and an intelligent cleaning path can be realized. For example: planning the cleaning path of irregular-shaped swimming pools, and the working location and working status of the robotic pool cleaner can be known in time, which greatly improves the convenience of use and cleaning efficiency, and has industrial applicability and significant economic benefits.

What is claimed is:

1. A floating device, comprising: a floating base, a first power supply assembly and a wireless transmission module, wherein the wireless transmission module is packaged in the floating base;

the floating base has a shell structure, comprising a first upper shell and a first chamber shell, wherein the first chamber shell is sealed and fixed on a lower surface of the first upper shell, and the first power supply assembly is arranged in a sealed chamber enclosed by the first upper shell and the first chamber shell.

2. The floating device according to claim 1, wherein the floating base has a raised portion protruding from its upper surface, and the wireless transmission module is packaged in the raised portion.

3. The floating device according to claim 2, wherein the first power supply assembly is packaged inside the floating base and electrically connected to the wireless transmission module.

4. The floating device according to claim 3, wherein the upper surface of the floating base is covered with a first solar panel, wherein the first solar panel is electrically connected to the first power supply assembly.

5. The floating device according to claim 3, wherein the floating device further comprises a first main control board, wherein the first main control board is arranged to communicate with the wireless transmission module and to be electrically connected to the first power supply assembly.

6. The floating device according to claim 5, wherein the first main control board is arranged to be packaged inside the floating base.

7. The floating device according to claim 2, wherein the floating base is provided with at least one charging interface configured to charge the first power supply assembly.

8. The floating device according to claim 7, wherein the charging interface is contact or contactless.

9. The floating device according to claim 7, wherein the charging interface is arranged on the upper surface of the floating base.

10. The floating device according to claim 2, wherein the wireless transmission module is packaged at a top part of the raised portion.

11. The floating device according to claim 10, wherein the top part of the raised portion has a hollow structure and the wireless transmission module is arranged in the hollow structure at the top part of the raised portion.

12. The floating device according to claim 11, wherein the raised portion comprises a second upper shell and a second lower shell fixedly connected to the second upper shell, the second lower shell is fixedly connected to the floating base, the wireless transmission module is packaged inside the hollow structure enclosed by the second upper shell and the second lower shell.

13. The floating device according to claim 2, wherein the raised portion has a U-shaped handle structure with an opening facing downwards, and the hollow structure of the raised portion is arranged at the middle connecting section of the U-shaped handle structure.

14. The floating device according to claim 2, wherein the wireless transmission module comprises at least one of: a WIFI module, a Bluetooth module and a Zigbee module.

15. The floating device according to claim 1, wherein a first sealing ring is provided between the first chamber shell and the first upper shell.

16. The floating device according to claim 1, wherein the floating base further comprises a first lower shell, wherein the first lower shell is frame-shaped and is arranged to surround the first chamber shell, and to be fixedly connected with the first upper shell.

17. The floating device according to claim 16, wherein the first lower shell is provided with a lower groove, and an inner side of the lower groove is higher than an outer side of the lower groove, and the inner side of the lower groove is seal-connected with the first upper shell.

18. The floating device according to claim 17, wherein a second sealing ring is provided between the inner side of the lower groove and the first upper shell.

19. A robotic pool cleaner, comprising: a floating device, a cleaning device and a connecting cable, wherein a first power supply assembly of the floating device is connected to the cleaning device through the connecting cable, the floating device comprising a floating base and a wireless transmission module packaged therein; wherein the floating base has a shell structure, comprising a first upper shell and a first chamber shell, wherein the first chamber shell is sealed and fixed on a lower surface of the first upper shell, and the first power supply assembly is arranged in a sealed chamber enclosed by the first upper shell and the first chamber shell.

20. A floating device, comprising: a floating base and a wireless transmission module packaged therein, wherein the floating base has a raised portion protruding from its upper surface, a top part of the raised portion has a hollow structure and the wireless transmission module is arranged in the hollow structure at the top part of the raised portion.

* * * * *